US006768060B2

(12) United States Patent
Belli et al.

(10) Patent No.: US 6,768,060 B2
(45) **Date of Patent: *Jul. 27, 2004**

(54) CABLE WITH IMPACT-RESISTANT COATING

(75) Inventors: Sergio Belli, Leghorn (IT); Luigi Caimi, Lomagna (IT); Alberto Bareggi, Milan (IT); Luca Balconi, Bresso (IT)

(73) Assignee: Pirelli Cavi e Sistemi S.p.A., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 10/289,442

(22) Filed: Nov. 7, 2002

(65) Prior Publication Data

US 2003/0066675 A1 Apr. 10, 2003

Related U.S. Application Data

(63) Continuation of application No. 09/423,807, filed on Nov. 12, 1999, now Pat. No. 6,501,027, which is a continuation of application No. PCT/EP98/02698, filed on May 8, 1998.

(60) Provisional application No. 60/047,127, filed on May 20, 1997.

(30) Foreign Application Priority Data

May 15, 1997 (EP) ..... 97107969

(51) Int. Cl.[7] ..... H01B 7/00

(52) U.S. Cl. ..... 174/110 F; 174/113 R; 174/120 R

(58) Field of Search ..... 174/110 F, 113 R, 174/120 R, 120 SC

(56) References Cited

U.S. PATENT DOCUMENTS 3,516,859 A 6/1970 Gerland et al.

(List continued on next page.)

FOREIGN PATENT DOCUMENTS

DE 15 15 709 6/1969

(List continued on next page.)

OTHER PUBLICATIONS

American Society for Testing and Materials, *Standard Test Methods for Flexural Properties of Unreinforced and Reinforced Plastics and Electrical Insulating Materials; ASTM D790–96a* pp. 1–11, Jan. 9, 2004.

ASTM Designation, *Tentative Method of Test for Tensile Properties of Plastics; ASTMD 638–58 T*, pp. 321–334, 1958.

*Primary Examiner*—Chau N. Nguyen

(74) *Attorney, Agent, or Firm*—Finnegan, Henderson, Farabow, Garrett, & Dunner, L.L.P.

(57) ABSTRACT

The present invention relates to a coating for cables which is capable of protecting the cable against accidental impacts. By inserting into the structure of a power transmissioncable a suitable coating of expanded polymer material of adequate thickness, preferably in contact with the sheath of outer polymer coating, it is possible to obtain a cable which has a high impact strength. The Applicant has moreover observed that an expanded polymer material used as a coating for cables makes it possible to obtain a higher impact strength for this cable than using a similar coating based on the same polymer which is not expanded. A cable with a coating of this type has various advantages over a conventional cable with metal armor, such as, for example, easier processing, a reduction in the weight and dimensions of the finished cable and a lower environmental impact as regards recycling of the cable once its working cycle is over.

23 Claims, 5 Drawing Sheets

U.S. PATENT DOCUMENTS

| | | | | | |
|---|---|---|---|---|---|
| 4,104,210 | A | | 8/1978 | Coran et al. | |
| 4,711,811 | A | | 12/1987 | Randa | |
| 5,110,998 | A | | 5/1992 | Muschiatti | |
| 5,153,381 | A | | 10/1992 | Ganatra et al. | |
| 6,239,377 | B1 | * | 5/2001 | Nishikawa | 174/110 R |
| 6,501,027 | B1 | * | 12/2002 | Belli et al. | 174/110 F |

FOREIGN PATENT DOCUMENTS

| | | | |
|---|---|---|---|
| DE | 7 1225 12 | | 11/1971 |
| DE | 81 03 947.6 | | 11/1989 |
| DE | 92 16 118.9 | | 2/1993 |
| EP | 0 442 346 | | 8/1991 |
| EP | 324430 | | 6/1995 |
| FR | 1.228.888 | | 9/1960 |
| JP | 7-320550 | | 12/1995 |
| JP | 10-40744 | * | 2/1998 |
| WO | WO 93/15512 | | 8/1993 |

* cited by examiner

Fig. 4 Impact test from 50 cm height
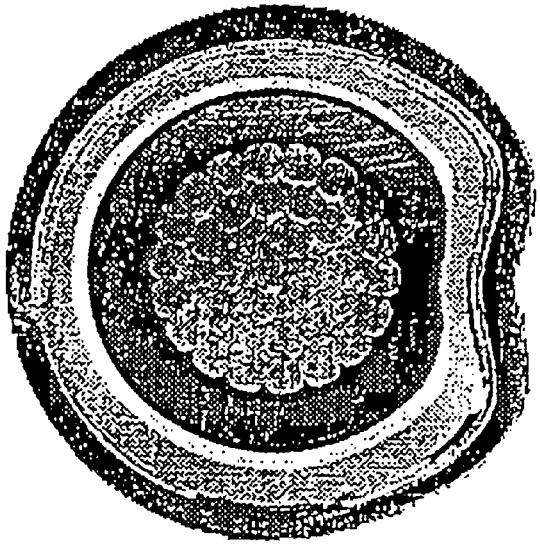
b) Conventional armored cable
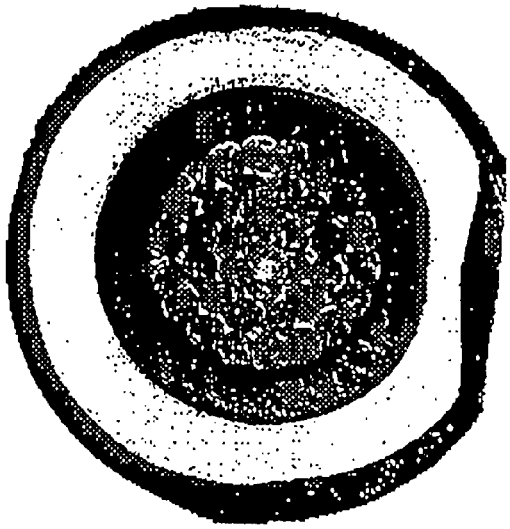
a) Cable no. 10

Fig. 5 Impact test from 20 cm height
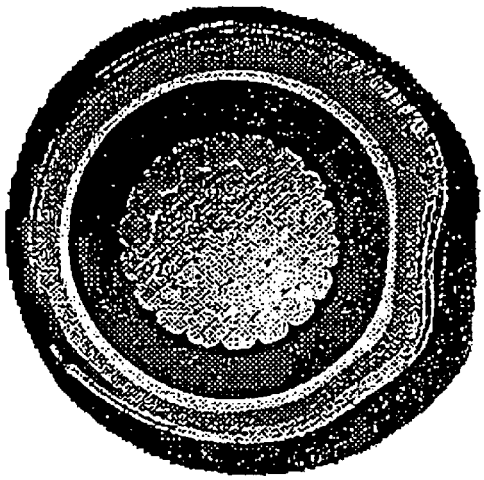
b) Conventional armored cable
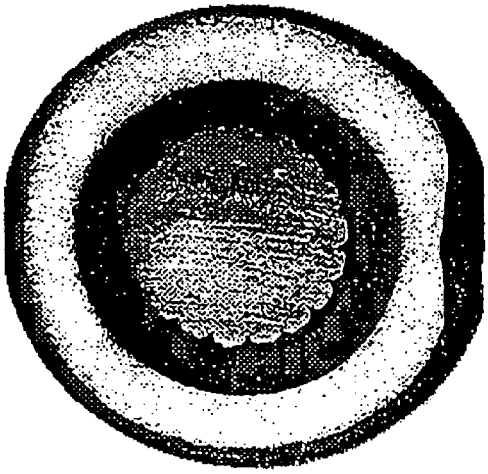
a) Cable no. 10

CABLE WITH IMPACT-RESISTANT COATING

RELATED APPLICATIONS

This application is a continuation of application Ser. No. 09/423,807, filed Nov. 12, 1999 now U.S. Pat. No. 6,501,027, which is a continuation of International Application No. PCT/EP98/02698, filed May 8, 1998, and relies on the benefit of priority under 35 U.S.C. § 119 of U.S. provisional patent application Serial No. 60/047,127, filed May 20, 1997 and EP 97107969.4 filed May 15, 1997, all of which are incorporated herein by reference.

FIELD OF INVENTION

The present invention relates to a coating for cables which is capable of protecting the cable from accidental impacts.

DESCRIPTION OF THE RELATED ART

Accidental impacts on a cable, which may occur, for example, during their transportation, laying etc., may cause a series of structural damage to the cable, including deformation of the insulating layer, detachment of the insulating layer from the semiconductive layer, and the like; this damage may cause variations in the electrical gradient of the insulating coating, with a consequent decrease in the insulating capacity of this coating.

In the cables which are currently commercially available, for example in those for low- or medium-tension power transmission or distribution, metal armor capable of withstanding such impacts is usually applied in order to protect cables from possible damages caused by accidental impacts. This armor may be in the form of tapes or wires (generally made of steel), or alternatively in the form of a metal sheath (generally made of lead or aluminum); this armor is, in turn, usually clad with an outer polymer sheath. An example of such a cable structure is described in U.S. Pat. No. 5,153,381.

The Applicant has observed that the presence of the abovementioned metal armor has a certain number of drawbacks. For example, the application of the said armor includes one or more additional phases in the processing of the cable. Moreover, the presence of the metal armor increases the weight of the cable considerably, in addition to posing environmental problems since, if it needs to be replaced, a cable constructed in this way is not easy to dispose of.

The Japanese patent published under the number (Kokai) 7-320550 describes a domestic cable with an impact-resistant coating 0.2–1.4 mm in thickness, placed between the insulator and the outer sheath. This impact-resistant coating is a non-expanded polymer material containing a polyurethane resin as main component.

On the other hand, use of expanded polymeric materials in cables' construction is known for a variety of purposes.

For instance, German patent application no. P 15 15 709 discloses the use of an intermediate layer between the outer plastic sheath and the inner metallic sheath of a cable, in order to increase the resistance of the outer plastic sheath to low temperatures. No mention is made in such document about protecting the inner structure of the cable with said intermediate layer. As a mattter of fact, such intermediate layer should compensate for elastic tensions generated in the outer plastic sheath due to temperature's lowering and may consist of loosely disposed glass fibers or of a material which may either be expanded or incorporating hollow glass spheres.

Another document, German utility model no. G 81 03 947.6, discloses an electric cable for use in connections inside apparatuses and machines, having particular mechanical resistance and flexibility. Said cable is specifically designed for passing on a pulley and is sufficiently flexible in order to recover its straight structure after the passage on said pulley. Accordingly, this kind of cable is specifically aimed to resist to mechanical loads of the static type (such as those generated during the passage onto a pulley), and its main feature is the flexibility. It is readily apparent to those skilled in the art that this kind of cable substantially differs from low- or medium-tension power transmission or distribution having a metal armor which, rather to be flexible, should be capable of withstanding dynamic loads due to impacts of a certain strength onto the cable.

In addition, in signal transmission cables of the coaxial or twisted pair type, it is known to use expanded materials in order to insulate a conductive metal. Coaxial cables are usually intended to carry high-frequency signals, such as coaxial cables for TV (CATV) (10–100 MHz), satellite cables (up to 2 GHz), coaxial cables for computers (above 1 MHz); traditional telephone cables usually carry signals with frequencies of about 800 Hz.

The purpose of using an expanded insulator in such cables is to increase the transmission speed of the electrical signals, in order to approach the ideal speed of signal transmission in an aerial conductive metal (which is close to the speed of light). The reason for this is that, compared with non-expanded polymer materials, expanded materials generally have a lower dielectric constant (K), which is proportionately closer to that of air (K=1) the higher the degree of expansion of the polymer.

For example, U.S. Pat. No. 4,711,811 describes a signal transmission cable having an expanded fluoropolymer as insulator (thickness of 0.05–0.76 mm) clad with a film of ethylene/tetrafluoroethylene or ethylene/chlorotrifluoroethylene copolymer (thickness of 0.013–0.254 mm). As described in that patent, the purpose of the expanded polymer is to insulate the conductor, while the purpose of the film of non-expanded polymer which clads the expanded polymer is to improve the mechanical properties of the insulation, in particular by imparting the necessary compression strength when two insulated conductors are twisted to form the so-called "twisted pair".

Patent EP 442,346 describes a signal transmission cable with an insulating layer based on expanded polymer, placed directly around the conductor; this expanded polymer has an ultramicrocellular structure with a void volume of greater than 75% (corresponding to a degree of expansion of greater than 300%). The ultramicrocellular structure of this polymer should be such that it is compressed by at least 10% under a load of $6.89\times10^4$ Pa and recovers at least 50% of its original volume after removal of the load; these values correspond approximately to the typical compression strength values which the material needs to have in order to withstand the compression during twisting of the cables.

In International patent application WO 93/15512, which also relates to a signal transmission cable with an expanded insulating coating, it is stated that by coating the expanded insulator with a layer of non-expanded insulating thermoplastic polymer (as described, for example, in the abovementioned U.S. Pat. No. 4,711,811) the required compression strength is obtained, this however reducing the speed of propagation of the signal. The said patent application WO 93/15512 describes a coaxial cable with a double layer of insulating coating, where both the layers consist of an expanded polymer material, the inner layer consisting of microporous polytetrafluoroethylene (PTFE) and the outer layer consisting of a closed-cell expanded polymer, in particular perfluoroalkoxytetrafluoroethylene (PFA) polymers. The insulating coating based on expanded polymer is obtained by extruding the PFA polymer over the inner layer of PTFE insulator, injecting Freon 113 gas as expanding agent. According to the details given in the description, this closed-cell expanded insulator makes it possible to maintain a high speed of signal transmission. It is moreover defined in that patent application as being resistant to compression, although no numerical data regarding this compression strength are given. The description emphasizes the fact that conductors clad with such a double-layer insulator can be twisted. Moreover, according to that patent application, the increase in void volume in the outer expanded layer makes it possible to obtain an increase in the speed of transmission, thereby giving rise to small variations in the capacity of this coating to oppose the compression of the inner expanded layer.

As is seen from the abovementioned documents, the main purpose of using "open cell" expanded polymer materials as insulating coatings for signal transmission cables is to increase the speed of transmission of the electrical signal; however, these expanded coatings have the drawback of having an insufficient compression strength. A few expanded materials are also generically defined as "resistant to compression", since they have to ensure not only a high speed of signal transmission but also a sufficient resistance to the compression forces which are typically generated when two conductors coated with the abovementioned expanded insulation are twisted together; accordingly, also in this case, the applied load is substantiantially of static type.

Thus, while, on the one hand, it is necessary for these insulating coatings made of expanded polymer material for signal transmission cables to have characteristics such that they can bear a relatively modest compression load (such as that which arises when two cables are twisted together), on the other hand, no mention is made in any document known to the Applicant of any type of impact strength which may be provided by an expanded polymer coating. Moreover, although such an expanded insulating coating promotes a higher speed of signal transmission, this is considered to be less advantageous than a coating made of a similar non-expanded material as regards the compression strength, as reported in the abovementioned patent application WO 93/15512.

The Applicant has now found that by inserting into the structure of a power transmission cable a suitable coating made of expanded polymer material of adequate thickness and flexural modulus, preferably in contact with the sheath of outer polymer coating, it is possible to obtain a cable having a high impact strength, thereby making it possible to avoid the use of the abovementioned protective metal armor in the structure of this cable. In particular, the Applicant has observed that the polymer material should be selected in order to have a sufficiently high flexural modulus, measured before its expansion, so to achieve the desired impact resistant properties and avoid possible damages of the inner structure of the cable due to undesired impacts on the outer surface of it. In the present description, the term "impact" is intended to encompass all those dynamic loads of a certain energy capable to produce substantial damages to the structure of conventional unarmored cables, while while having negligible effects on the structure of conventional armored cables. As an indication, such an impact may be considered an impact of about 20–30 joule produced by a V-shaped rounded-edge punch, having a curvature radius of about 1 mm, onto the outer sheath of the cable.

The Applicant has moreover observed that, surprisingly, an expanded polymer material used as a coating for cables according to the invention makes it possible to obtain an impact strength which is better than that obtained using a similar coating based on the same polymer which is not expanded.

SUMMARY OF THE INVENTION

A cable with a coating of this type has various advantages over a conventional cable with metal armor such as, for example, easier processing, a reduction in the weight and dimensions of the finished cable and a reduced environmental impact as regards recycling of the cable once its working cycle is over.

One aspect of the present invention thus relates to a power transmission cable comprising a) a conductor;

b) at least one layer of compact insulating coating, c) a coating made of expanded polymer material, wherein said polymer material has predetermined mechanical strength properties and a predetermined degree of expansion so as to impart impact resistant properties to said cable.

According to a preferred aspect of the present invention, the expanded polymer material is obtained from a polymer material which has, before expansion, a flexural modulus at room temperature, measured according to ASTM standard D790, higher than 200 MPa, preferably between 400 MPa and 1500 MPa, values of between 600 MPa and 1300 MPa being particularly preferred.

According to a preferred aspect, said polymer material has a degree of expansion of from abuot 20% to about 3000%, preferably from about 30% to about 500%, a degree of expansion of from about 50% to about 200% being particularly preferred.

According to a preferred embodiment of the present invention, the coating of expanded polymer material has a thickness of at least 0.5 mm, preferably between 1 and 6 mm, in particular between 2 and 4 mm. According to a preferred aspect of the present invention, this expanded polymer material is chosen from polyethylene (PE), low density PE (LDPE), medium density PE (MDPE), high density PE (HDPE) and linear low density PE (LLDPE); polypropylene (PP); ethylene-propylene rubber (EPR), ethylene-propylene copolymer (EPM), ethylene-propylene-diene terpolymer (EPDM); natural rubber; butyl rubber; ethylene/vinyl acetate (EVA) copolymer; polystyrene; ethylene/acrylate copolymer, ethylene/methyl acrylate (EMA) copolymer, ethylene/ethyl acrylate (EEA) copolymer, ethylene/butyl acrylate (EBA) copolymer; ethylene/$\alpha$-olefin copolymer; acrylonitrile-butadiene-styrene (ABS) resins; halogenated polymer, polyvinyl chloride (PVC); polyurethane (PUR); polyamide; aromatic polyester, polyethylene terephthalate (PET), polybutylene terephthalate (PBT); and copolymers or mechanical mixtures thereof.

According to a further preferred aspect, this polymer material is a polyolefin polymer or copolymer based on PE and/or PP, preferably modified with ethylene-propylene rubber, in which the PP/EPR weight ratio is between 90/10 and 50/50, preferably between 85/15 and 60/40, in particular about 70/30.

According to a further preferred aspect, this polyolefin polymer or copolymer based on PE and/or PP contains a predetermined amount of vulcanized rubber in powder form, preferably between 10% and 60% of the weight of the polymer.

According to a further preferred aspect, this cable moreover comprises an outer polymer sheath, which is preferably in contact with the expanded polymer coating, this sheath preferably having a thickness of at least 0.5 mm, preferably between 1 and 5 mm.

Another aspect of the present invention relates to a method for imparting impact strength to a cable, which comprises coating this cable with a coating made of expanded polymer material.

According to a preferred aspect, this method for imparting impact strength to a cable moreover comprises coating this expanded coating with an outer protective sheath.

A further aspect of the present invention relates to the use of an expanded polymer material in order to impart impact strength to a power transmission cable.

A further aspect of the present invention relates to a method for evaluating the impact strength of a cable comprising at least one insulating coating, this method consisting in a) measuring the average peel strength of the said insulating layer;

b) subjecting the cable to an impact of predetermined energy;

c) measuring the peel strength of the said insulating layer at the point of impact;

d) checking that the difference between the average peel strength and the peel strength measured at the point of impact is less than a predetermined value for the said cable relative to the average peel strength.

According to a preferred aspect, this peel strength is measured between the layer of insulating coating and the outer layer of semiconductive coating.

In the present description, the term "degree of expansion of the polymer" is understood to refer to the expansion of the polymer determined in the following way:

$$G\ (\text{degree of expansion})=(d_0/d_e-1)\cdot 100$$

where $d_0$ indicates the density of the non-expanded polymer (that is to say the polymer with a structure which is essentially free of void volume) and $d_e$ indicates the apparent density measured for the expanded polymer.

For the purposes of the present description, the term "expanded" polymer is understood to refer to a polymer within the structure of which the percentage of void volume (that is to say the space not occupied by the polymer but by a gas or air) is typically greater than 10% of the total volume of this polymer.

In the present description, the term "peel" strength is understood to refer to the force required to separate (peel) a layer of coating from the conductor or from another layer of coating; in the case of separation of two layers of coating from each other, these layers are typically the insulating layer and the outer semiconductive layer.

Typically, the insulating layer of power transmission cables has a dielectric constant (K) of greater than 2. Moreover, in contrast with signal transmission cables, in which the "electrical gradient" parameter does not assume any importance, electrical gradients ranging from about 0.5 kV/mm for low tension, up to about 10 kV/mm for high tension, are applied in power transmission cables; thus, in these cables, the presence of inhomogeneity in the insulating coating (for example void volumes), which could give rise to a local variation in the dielectric rigidity with a consequent decrease in the insulating capacity, tends to be avoided. This insulating material will thus typically be a compact polymer material, in which, in the present description, the term "compact" insulator is understood to refer to an insulating material which has a dielectric rigidity of at least 5 kV/mm, preferably greater than 10 kV/mm, in particular greater than 40 kV/mm for medium-high tension power transmission cables. In contrast with an expanded polymer material, this compact material is substantially free of void volume within its structure; in particular, this material will have a density of 0.85 g/cm$^3$ or more.

In the present description, the term low tension is understood to refer to a tension of up to 1000 V (typically greater than 100 V), the term medium tension is understood to refer to a tension from about 1 to about 30 kV and the term high tension is understood to refer to a tension above 30 kV. Such power transmission cables typically operate at nominal frequencies of 50 or 60 Hz.

Although, in the course of the description, the use of the expanded polymer coating is illustrated in detail with reference to power transmission cables, in which this coating may advantageously replace the metal armor currently used in such cables, it is clear to those skilled in the art that this expanded coating may advantageously be used in any type of cable for which it might be desired to impart suitable impact protection to such a cable. In particular, the definition of power transmission cables includes not only those specifically of the type for low and medium tension but also cables for high-tension power transmission.

BRIEF DESCRIPTION OF THE DRAWINGS

The invention may be further understood with the aid of the following figures:

FIG. 4*a* shows resulting deformation of the cable made according to the invention after an impact test from 50 cm height.

FIG. 4*b* shows resulting deformation of the conventional armored cable after an impact test from 50 cm height.

FIG. 5*a* shows resulting deformation of the cable made according to the invention after an impact test from 20 cm height.

FIG. 5*b* shows resulting deformation of the convention armored cable after an impact test from 20 cm height.

DESCRIPTION OF THE PREFERRED EMBODIMENTS

Figure 1:
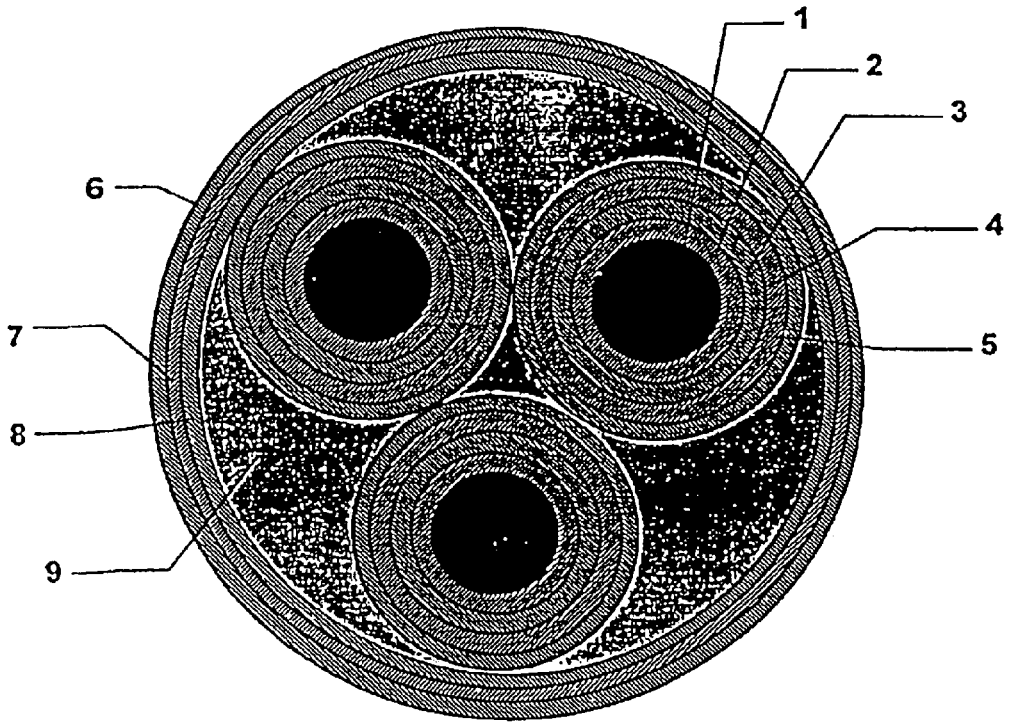
FIG. 1 shows a power transmission cable according to the state of the art, of the tripolar type with metal armor.

FIG. 1 is the cross-sectional diagram of a medium-tension power transmission cable according to the state of the art, of the tripolar type with metal armor. This cable comprises three conductors (1), each clad with an inner semiconductive coating (2), an insulating layer (3), an outer semiconductive layer (4) and a metal screen (5); for simplicity, this semi-finished structure will be defined in the rest of the description as the "core". The three cores are roped together and the star-shaped areas between them are filled with a filling material (9) (generally elastomeric mixtures, polypropylene fibers and the like) in order to make the cross-sectional structure circular, the whole in turn being coated with an inner polymer sheath (8), an armor of metal wires (7) and an outer polymer sheath (6).

Figure 2:
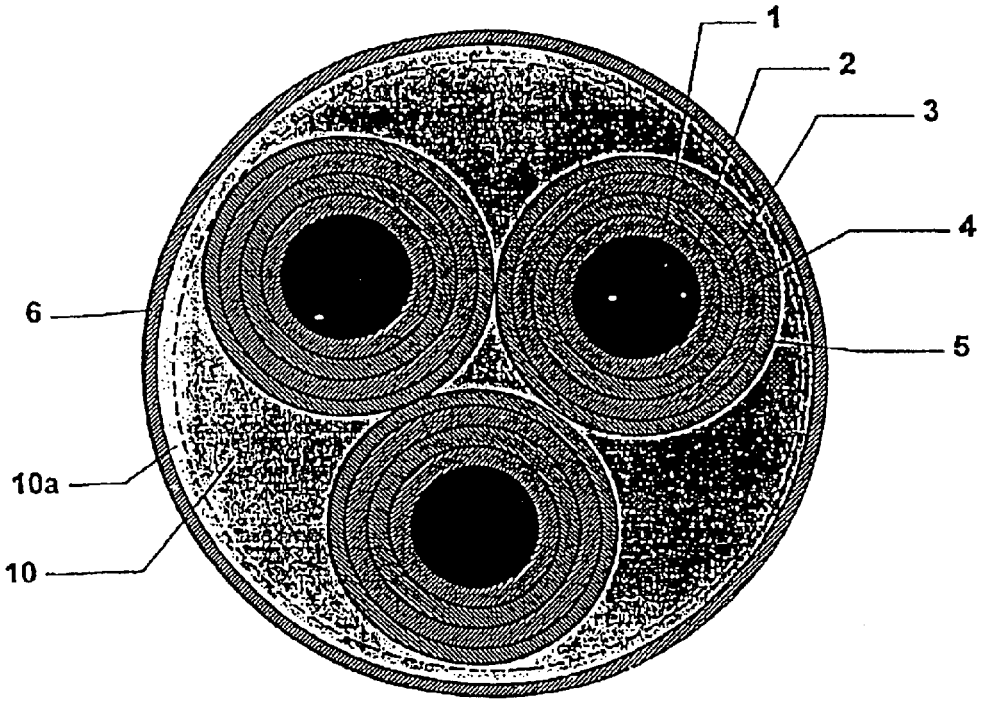
FIG. 2 shows a first embodiment of a cable according to the invention of tripolar type.

FIG. 2 is the cross-sectional diagram of a cable according to the invention, also of the tripolar type for medium-tension power transmission. This cable comprises the three conductors (1), each clad with an inner semiconductive coating (2), an insulating layer (3), an outer semiconductive layer (4) and a metal screen (5); the star-shaped areas between the cores are filled in this case with an impact-resistant expanded polymer material (10) which is, in turn, coated with an outer polymer sheath (6). In the expanded polymer coating (10), a circular rim (10*a*) which corresponds to the minimum thickness of expanded polymer coating, in proximity to the outer surface of the cores, is also indicated (by means of a dotted line).

Figure 3:
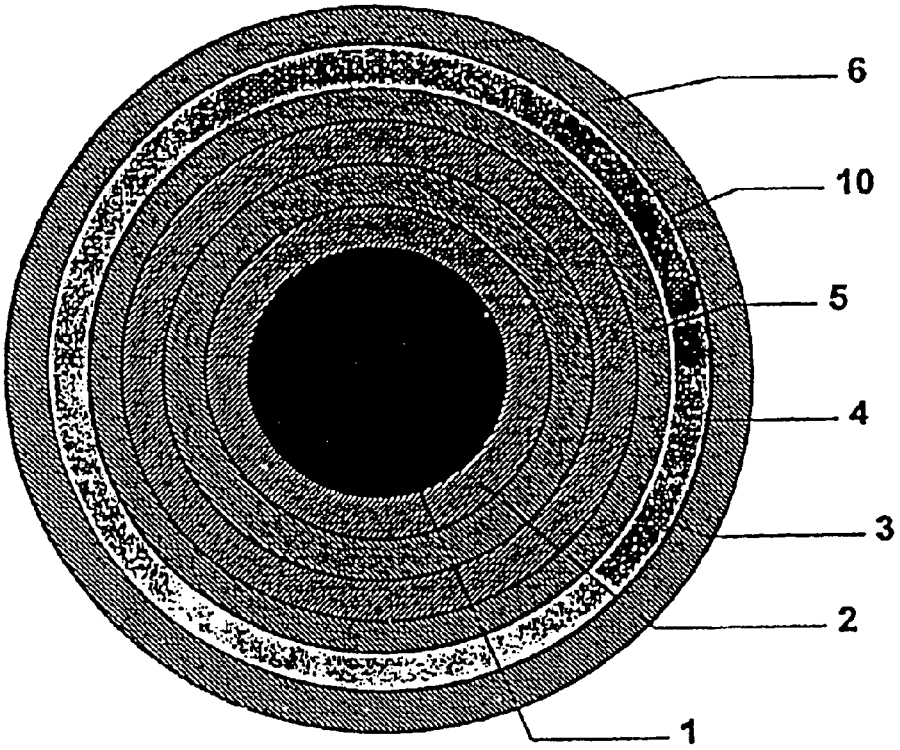
FIG. 3 shows a second embodiment of a cable according to the invention of unipolar type.

FIG. 3 is the cross-sectional diagram of a cable according to the invention, of unipolar type for medium-tension power transmission. This cable comprises a central conductor (1), clad with an inner semi-conductive coating (2), an insulating layer (3), an outer semiconductive layer (4), a metal screen (5), a layer of expanded polymer material (10) and an outer polymer sheath (6). In the case of this unipolar cable represented in FIG. 3, since the core has a circular cross-section, the circular rim (lOa) indicated in the case of the tripolar cable coincides with the layer of expanded polymer material (10).

These figures obviously only show a few of the possible embodiments of cables in which the present invention may advantageously be used. It is clear that suitable modifications known in the art may be made to these embodiments without any limitations to the application of the present invention being implied thereby. For example, with reference to FIG. 2, the star-shaped areas between the cores may be filled beforehand with a conventional filling material, thus obtaining a semi-processed cable of cross-section corresponding approximately to the circular cross-section contained within the circular rim (10*a*); it is then advantageously possible to extrude over this semi-processed cable of cross-sectional area the layer of expanded polymer material (10), in a thickness corresponding approximately to the circular rim (10*a*), and subsequently the outer sheath (6). Alternatively, cores may be provided with a cross-sectional sector, in such a way that when these cores are joined together a cable of approximately circular cross-section is formed, without the need to use the filling material for the star-shaped areas; the layer of impact-resistant expanded polymer material (10) is then extruded over these cores thus joined together, followed by the outer sheath (6).

In the case of cables for low-tension power transmission, the structure of these cables will usually comprise the only insulating coating placed directly in contact with the conductor, which is in turn coated with the coating of expanded polymer material and with the outer sheath.

Further solutions are well known to a person skilled in the art, who is capable of evaluating the most convenient solution, based on, for example, the costs, the type of positioning of the cable (aerial, inserted in pipes, buried directly into the ground, inside buildings, under the sea, etc.), the operating temperature of the cable (maximum and minimum temperatures, temperature ranges of the environment) and the like.

The impact-resistant expanded polymer coating may consist of any type of expandable polymer such as, for example, polyolefins, polyolefin copolymers, olefin/ester copolymers, polyesters, polycarbonates, polysulfones, phenolic resins, ureic resins and mixtures thereof. Examples of suitable polymers are polyethylene (PE), in particular low density PE (LDPE), medium density PE (MDPE), high density PE (HDPE) and linear low density PE (LLDPE); polypropylene (PP); ethylene-propylene rubber (EPR), in particular ethylene-propylene copolymer (EPM) or ethylene-propylene-diene terpolymer (EPDM); natural rubber; butyl rubber; ethylene/vinyl acetate (EVA) copolymer; polystyrene; ethylene/acrylate copolymer, in particular ethylene/methyl acrylate (EMA) copolymer, ethylene/ethyl acrylate (EEA) copolymer, ethylene/butyl acrylate (EBA) copolymer; ethylene/$\alpha$-olefin copolymer; acrylonitrile-butadiene-styrene (ABS) resins; halogenated polymers, in particular polyvinyl chloride (PVC); polyurethane (PUR); polyamides; aromatic polyesters, such as polyethylene terephthalate (PET) or polybutylene terephthalate (PBT); and copolymers or mechanical mixtures thereof. Preferably, polyolefin polymers or copolymers are used, in particular those based on PE and/or PP mixed with ethylene-propylene rubbers. Advantageously, polypropylene modified with ethylene-propylene rubber (EPR) may be used, the PP/EPR weight ratio being between 90/10 and 50/50, preferably between 85/15 and 60/40, a weight ratio of about 70/30 being particularly preferred.

According to a further aspect of the present invention, the Applicant has moreover observed that it is possible to mix mechanically the polymer material which is subjected to the expansion, in particular in the case of olefin polymers, specifically polyethylene or polypropylene, with a predetermined amount of rubber in powder form, for example vulcanized natural rubber.

Typically, these powders are formed from particles with sizes of between 10 and 1000 $\mu$m, preferably between 300 and 600 $\mu$m. Advantageously, vulcanized rubber rejects derived from the processing of tires may be used. The percentage of rubber in powder form may range from 10% to 60% by weight relative to the polymer to be expanded, preferably between 30% and 50%.

The polymer material to be expanded, which is either used without further processing or which is used as an expandable base in a mixture with powdered rubber, will have to have a rigidity such that, once it is expanded, it ensures a certain magnitude of desired impact resistance, so as to protect the inner part of the cable (that is to say the layer of insulator and the semiconductive layers which may be present) from damage following accidental impacts which may occur. In particular, this material will have to have a sufficiently high capacity to absorb the impact energy, so as to transmit to the underlying insulating layer an amount of energy which is such that the insulating properties of the underlying coatings are not modified beyond a predetermined value. The reason for this, as illustrated in greater detail in the description which follows, is that the Applicant has observed that in a cable subjected to an impact, a difference is observed, between the average value and the value measured at the point of impact, of the peel strength of the underlying insulating coatings; advantageously, this peel strength may be measured between the insulating layer and the outer semiconductive layer. The difference in this strength is proportionately greater the greater the impact energy transmitted to the underlying layers; in the case where the peel strength is measured between the insulating layer and the outer semiconductive layer, it has been evaluated that the protective coating offers a sufficient protection to the inner layers when the difference in peel strength at the point of impact, relative to the average value, is less than 25%.

The Applicant has observed that a polymer material chosen from those mentioned above is particularly suitable for this purpose, this material having, before expansion, a flexural modulus at room temperature of greater than 200

MPa, preferably of at least 400 MPa, measured according to ASTM standard D790. On the other hand, since excessive rigidity of the expanded material may make the finished product difficult to handle, it is preferred to use a polymer material which has a flexural modulus at room temperature of less than 2000 MPa. Polymer materials which are particularly suitable for this purpose are those which have, before expansion, a flexural modulus at room temperature of between 400 and 1800 MPa, a polymer material with a flexural modulus at room temperature of between 600 and 1500 MPa being particularly preferred.

These flexural modulus values may be characteristic of a specific material or may result from the mixing of two or more materials having different moduli, mixed in a ratio such as to obtain the desired rigidity value for the material. For example, polypropylene, which has a flexural modulus of greater than 1500 MPa, may be appropriately modified with suitable amounts of ethylene-propylene rubber (EPR), having a modulus of about 100 MPa, for the purpose of lowering its rigidity in a suitable manner.

Examples of commercially available polymer compounds are:

low density polyethylene: Riblene FL 30 (Enichem);

high density polyethylene: DGDK 3364 (Union Carbide);

polypropylene: PF 814 (Montell);

polypropylene modified with EPR: Moplen EP-S 30R, 33R and 81R (Montell); Fina-Pro 5660G, 4660G, 2660S and 3660S (Fina-Pro).

The degree of expansion of the polymer and the thickness of the coating layer will have to be such that they ensure, in combination with the outer polymer sheath, resistance to typical impacts which occur during the handling and laying of the cable.

As mentioned previously, the "degree of expansion of the polymer" is determined in the following way:

$$G\ (\text{degree of expansion})=(d_0/d_e-1)\cdot 100$$

where $d_0$ indicates the density of the non-expanded polymer and $d_e$ indicates the apparent density measured for the expanded polymer.

The Applicant has observed that, insofar as the maintenance of the desired impact-resistance characteristics allows, for an equal thickness of the expanded layer, it is preferable to use a polymer material having a high degree of expansions since, in this way, it is possible to limit the amount of polymer material used, with advantages in terms of both economy and reduced weight of the finished product.

The degree of expansion is very variable, both as a function of the specific polymer material used and as a function of the thickness of the coating which it is intended to use; in general, this degree of expansion may range from 20% to 3000%, preferably from 30% to 500%, a degree of expansion of between 50% and 200% being particularly preferred. The expanded polymer generally has a closed-cell structure.

The Applicant has observed that beyond a certain degree of expansion, the capacity of the polymer coating to give the required impact strength decreases. In particular, it has been observed that the possibility of obtaining high degrees of expansion of the polymer by maintaining a high efficacy of protection against impacts may be correlated with the value of the flexural modulus of the polymer to be expanded. The reason for this is that the Applicant has observed that the modulus of the polymer material decreases as the degree of expansion of this material increases, approximatly according to the following formula:

$$E_2/E_1=(\rho_2/\rho_1)^2$$

wherein:

$E_2$ represents the flexural modulus of the polimer at the higher degree of expansion;

$E_1$ represents the flexural modulus of the polimer at the lower degree of expansion $\rho_2$ represents the apparent density of the polymer at the higher degree of expansion; and $\rho_1$ represents the apparent density of the polymer at the lower degree of expansion;

As a guidance, for a polymer with a flexural modulus of about 1000 MPa, a variation in the degree of expansion of from 25% to 100% entails an approximate halving of the value of the flexural modulus for the material. Polymer materials which have a high flexural modulus may therefore be expanded to a greater degree than polymer materials which have low modulus values, without this prejudicing the ability of the coating to withstand impacts.

Another variable which is liable to influence the impact strength of the cable is the thickness of the expanded coating; the minimum thickness which is capable of ensuring the impact strength which it is desired to obtain with such a coating will depend mainly on the degree of expansion and on the flexural modulus of this polymer. In general, the Applicant has observed that, for the same polymer and for the same degree of expansion, by increasing the thickness of the expanded coating it is possible to reach higher values of impact strength. However, for the purpose of using a limited amount of coating material, thus decreasing both the costs and the dimensions of the finished product, the thickness of the layer of expanded material will advantageously be the minimum thickness required to ensure the desired impact strength. In particular, for cables of the medium tension type, it has been observed that an expanded coating thickness of about 2 mm is usually capable of ensuring a sufficient resistance to the normal impacts to which a cable of this type is subjected. Preferably, the coating thickness will be greater than 0.5 mm, in particular between about 1 mm and about 6 mm, a thickness of between 2 mm and 4 mm being particularly preferred.

The Applicant has observed that it is possible to define, to a reasonable approximation, the relationship between the coating thickness and the degree of expansion of the polymer material, for materials with various flexural modulus values, such that the thickness of the expanded coating is suitably dimensioned as a function of the degree of expansion and of the modulus of the polymer material, in particular for thicknesses of the expanded coating of about 2–4 mm. Such a relationship may be expressed as follows:

$$V\cdot d_e \geq N$$

where

V represents the volume of expanded polymer material per linear meter of cable ($m^3/m$), this volume being relative to the circular rim defined by the minimum thickness of expanded coating, corresponding to the circular rim (10*a*) of FIG. 2 for multipolar cables, or to the coating (10) defined in FIG. 3 for unipolar cables;

$d_e$ represents the apparent density measured for the expanded polymer material ($kg/m^3$); and N is the result of the product of the two abovementioned values, which will have to be greater than or equal to:

0.03 for materials with a modulus>1000 MPa, 0.04 for materials with a modulus of 800–1000 MPa, 0.05 for materials with a modulus of 400–800 MPa, 0.06 for materials with a modulus <400 MPa.

The parameter V is related to the thickness (S) of the expanded coating by the following relationship:

$$V=\pi(2R_1 \cdot S+S^2)$$

where $R_1$ represents the inner radius of the circular rim (10*a*).

The parameter $d_e$ is related to the degree of expansion of the polymer material by the previous relationship:

$$G=(d_0/d_e-1)\cdot 100$$

Based on the abovementioned relationship, for an expanded coating about 2 mm in thickness, placed on a circular section of cable with a diameter of about 22 mm, for various materials having different flexural moduli at room temperature (Mf), it is found that this coating will have to have a minimum apparent density of about:

0.40 g/cm$^3$ for LDPE (Mf of about 200);

0.33 g/cm$^3$ for a 70/30 PP/EPR mixture (Mf of about 800);

0.26 g/cm$^3$ for HDPE (Mf of about 1000);

0.20 g/cm$^3$ for PP (Mf of about 1500).

These values of apparent density of the expanded polymer correspond to a maximum degree of expansion of about:

130% for LDPE ($d_0$=0.923)

180% for the PP/EPR mixture ($d_0$=0.890)

260% for HDPE ($d_0$=0.945)

350% for PP ($d_0$=0.900).

Similarly, for a thickness of the expanded coating of about 3 mm placed on a cable of identical dimensions, the following values of minimum apparent density are obtained:

0.25 g/cm$^3$ for LDPE;

0.21 g/cm$^3$ for the PP/EPR mixture;

0.17 g/cm$^3$ for HDPE;

0.13 g/cm$^3$ for PP;

corresponding to a maximum degree of expansion of about:

270% for LDPE;

320% for the PP/EPR mixture;

460% for HDPE;

600% for PP.

The results shown above indicate that in order to optimize the impact strength characteristics of an expanded coating of predetermined thickness, both the mechanical strength characteristics of the material (in particular its flexural modulus)) and the degree of expansion of said material should be taken in account. However, the values determined by applying the above relationship should not be considered as limiting the scope of the present invention. In particular, the maximum degree of expansion of polymers which have flexural modulus values close to the upper limits of the intervals defined for the variation of the number N (that is to say 400, 800 and 1000 MPa) may in reality be even greater than that calculated according to the above relationship; thus, for example, a layer of PP/EPR about 2 mm in thickness (with Mf of about 800 MPa) will still be able to provide the desired impact protection even with a degree of expansion of about 200%.

The polymer is usually expanded during the extrusion phase; this expansion may either take place chemically, by means of addition of a suitable "expanding" compound, that is to say one which is capable of generating a gas under defined temperature and pressure conditions, or may take place physically, by means of injection of gas at high pressure directly into the extrusion cylinder.

Examples of suitable chemical "expanders" are azodicarboamide, mixtures of organic acids (for example citric acid) with carbonates and/or bicarbonates (for example sodium bicarbonate).

Examples of gases to be injected at high pressure into the extrusion cylinder are nitrogen, carbon dioxide, air and low-boiling hydrocarbons such as propane and butane.

The protective outer sheath which clads the layer of expanded polymer may conveniently be of the type normally used. Materials for the outer coating which may be used are polyethylene (PE), in particular medium-density PE (MDPE) and high-density PE (HDPE), polyvinyl chloride (PVC), mixtures of elastomers and the like. MDPE or PVC is preferably used. Typically, the polymer material which forms this outer sheath has a flexural modulus of between about 400 and about 1200 MPa, preferably between about 600 MPa and about 1000 MPa.

The Applicant has observed that the presence of the outer sheath contributes towards providing the coating with the desired impact strength characteristics, in combination with the expanded coating. In particular, the Applicant has observed that this contribution of the sheath towards the impact strength, for the same thickness of expanded coating, increases as the degree of expansion of the polymer which forms this expanded coating increases. The thickness of this outer sheath is preferably greater than 0.5 mm, in particular between 1 and 5 mm, preferably between 2 and 4 mm.

The preparation of a cable with an impact strength according to the invention is described with reference to the cable structure diagram of FIG. 2, in which, however, the star-shaped spaces between the cores to be coated are filled, not directly with the expanded polymer (10) but rather with a conventional filler; the expanded coating is then extruded over this semi-processed cable, to form a circular rim (10*a*) around this semi-processed cable and is subsequently clad with the outer polymer sheath (2). The preparation of the cable cores, that is to say the assembly of the conductor (4), inner semiconductive layer (9), insulator (5), outer semiconductive layer (8) and metal screen (4), is carried out as known in the art, for example by means of extrusion. These cores are then roped together and the star-shaped spaces are filled with a conventional filling material (for example elastomeric mixtures, polypropylene fibers and the like), typically by means of extrusion of the filler over the roped cores, so as to obtain a semi-processed cable with a circular cross-section. The coating of expanded polymer (10) is then extruded over the filling material. Preferably, the die of the extruder head will have a diameter slightly smaller than the final diameter of the cable with expanded coating, in order to allow the polymer to expand outside the extruder.

It has been observed that, under identical extrusion conditions (such as spin speed of the screw, speed of the extrusion line, diameter of the extruder head and the like) the extrusion temperature is one of the process variables which has a considerable influence on the degree of expansion. In general, for extrusion temperatures below 160° C., it is difficult to obtain a sufficient degree of expansion; the extrusion temperature is preferably at least 180° C., in particular about 200° C. Usually, an increase in the extrusion temperature corresponds to a higher degree of expansion.

Moreover, it is possible to control to some extent the degree of expansion of the polymer by acting on the rate of cooling since, by appropriately slowing down or speeding up the cooling if the polymer which forms the expanded coating at the extruder outlet, it is possible to increase or decrease the degree of expansion of the said polymer.

As mentioned, the Applicant has observed that it is possible to determine quantitatively the effects of an impact on a cable coating by means of measuring the peel strength of the cable coating layers, differences between the average value of this peel strength and the value measured at the point of impact being evaluated. In particular, for cables of the medium-tension type, with a structure comprising an inner semiconductive layer, an insulating layer and an outer semiconductive layer, the peel strength (and the relative difference) may advantageously be measured between the layer of outer semiconductive material and the insulating layer.

The Applicant has observed that the effects of the particularly severe impacts impacts to which a cable may be subjected, in particular an armored medium-tension cable, may be reproduced by means of an impact test based on the French standard HN 33-S-52, relating to armored cables for high-tension power transmission, which allows for an energy of impact on the cable of about 72 joules (J).

The peel strength of the coating layer may be measured according to the French standard HN 33-S-52, according to which the force needed to be applied to separate the outer semiconductive layer from the insulating layer is measured. The Applicant has observed that by measuring this force continuously, at the points at which the impact takes place, force peaks are measured which indicate a variation in the cohesive force between the two layers. It was observed that these variations are generally associated with a decrease in the insulating capacity of the coating. The variation will be proportionately larger the smaller the impact strength provided by the outer covering (which, in the case of the present invention, consists of the expanded coating and the outer sheath). The size of the variation of this force measured at the points of impact, relative to the average value measured along the cable, thus provides an indication of the degree of protection provided by the protective coating. In general, variations in the peel strength of up to 20–25% relative to the average value are considered to be acceptable.

The characteristics of the expanded coating (material, degree of expansion, thickness), which may advantageously be used together-with a suitable protective outer polymer sheath, may be appropriately selectedaccording to the impact protection which it is intended to provide to the underlying cable structure, and also depending on the characteristics of the specific material used as insulator and/or semiconductor, such as hardness of the material, density and the like.

As it can be appreciated throughout the present description, the cable of the invention is particularly suitable to replace conventional armored cables, due to the advantageous properties of the expanded polymer coating with respect to metal armoring. However, its use should not be limited to such a specific application. As a matter of fact, the cable of the invention may advantageously be employed in all those application wherein a cable having enhanced impact-resistant properties would be desirable. In particular, the impact-resistant cable of the invention may replace conventional unarmored cables in all those application wherein, up to now, use of armored cables would have been advantageous but has been discouraged due to the drawbacks of the metal armoring.

A few illustrative examples are given herein-below in order to describe the invention in further detail.

EXAMPLE 1

Preparation of the Cable with Expanded Coating

In order to evaluate the impact strength of an expanded polymer coating according to the invention, various test pieces were prepared by extruding variable thicknesses of a few polymers with various degrees of expansion over a core composed of a multi-wire conductor about 14 mm in thickness coated with a layer of 0.5 mm of semiconductive material, a layer of 3 mm of an insulating mixture based on EPR and a further layer of 0.5 mm of "easy stripping" semiconductive material based on EVA supplemented with carbon black, for a total core thickness of about 22 mm.

Low density polyethylene (LDPE), high density polyethylene (HDPE), polypropylene (PP) a 70/30 by weight mechanical mixture of LDPE and finely powdered vulcanized natural rubber (particle size of 300–600 μm) (PE-powder), PP modified with EPR rubber (PP-EPR as a 70/30 by weight mixture) were used as polymer materials to be expanded; these materials are identified in the following text by the letters A to E and are described in detail in the following table:

| | Material | Brand name and manufacturer | Modulus (MPa) |
|---|---|---|---|
| A | LDPE | Riblene FL 30 - Enichem | 260 |
| B | HDPE | DGDK 3364 - Union Carbide | 1000 |
| C | PP | PF 814 - Montell | 1600 |
| D | PP-EPR | FINA-PRO 3660S | 1250 |
| E | PE/powder | Riblene FL 30 | |

The polymer was expanded chemically, alternatively using two different expanding compounds (CE), these being identified as follows:

| | Compound | Brand name and manufacturer |
|---|---|---|
| CE1 | azodicarboamide | Sarmapor PO - Sarma |
| CE2 | carboxylic acid-bicarbonate | Hydrocerol CF 70 - Boehringer Ingelheim |

The polymer to be expanded and the expanding compound were loaded (in the ratios indicated in Table 2) into an 80 mm–25 D single-screw extruder (Bandera); this extruder is equipped with a threaded transfer screw characterized by a depth in the final zone of 9.6 mm. The extrusion system consists of a male die capable of providing a smooth throughput of the core to be coated (generally with a diameter which is about 0.5 mm greater than the diameter of the core to be coated), and a female die in which the diameter is chosen so as to have a size about 2 mm less than the diameter of the cable with the expanded coating; in this way, the extruded material expands on exiting the extrusion head rather than inside this head or inside the extruder. The throughput speed of the core to be coated (speed of the extrusion line) is set as a function of the desired thickness of expanded material (see Table 2). At a distance of about 500 mm from the extrusion head is a cooling pipe (containing cold water) in order to stop the expansion and to cool down the extruded material. The cable is then wound on a bobbin.

The composition of the polymer material/expander mixture and the extrusion conditions (speed, temperature) were varied appropriately, as described in Table 2 below.

TABLE 2

| Expanding mixture and extrusion conditions | | | | |
|---|---|---|---|---|
| Cable No. | Material + % and type of expander | Extruder speed (rev/min) | (1)Extruder temp. (° C.) | Line speed (m/min) |
| 1 | A + 2% CE1 | 6.4 | 165 | 3 |
| 2 | A + 2% CE1 | 11.8 | 190–180 | 2 |
| 3 | A + 2% CE1 | 5.5 | 190–180 | 3 |
| 4 | A + 2% CE1 | 6.8 | 190–180 | 2 |
| 5 | A + 2% CE1 | 6.4 | 165 | 1.5 |
| 6 | A + 0.8% CE2 | 5.7 | 225–200 | 2 |
| 7 | C + 0.8% CE2 | 3.7 | 200 | 2 |
| 8 | C + 0.8% CE2 | 6.3 | 200 | 2 |
| 9 | E + 0.8% CE2 | 4.9 | 225–200 | 1.8 |
| 10 | B + 1.2% CE2 | 8.2 | 225–200 | 2 |
| 11 | D + 2% CE2 | 8 | 225–200 | 2 |

(1)The extrusion temperature relates to the cylinder and extrusion head. When only one value is given, these temperatures are identical. In the initial zone of the extruder, the temperature is about 150° C.

Sample 1 did not undergo expansion, presumably because the temperature of the extruder was too low (165° C.), and likewise, for the same reason, Sample 5 underwent limited expansion (only 5%).

The cable with the expanded coating was then subsequently coated with a conventional sheath of MDPE (CE 90—Materie Plastiche Bresciane) of variable thickness (see Table 3) by means of conventional extrusion methods, thus obtaining cable samples with the characteristics defined in Table 3; cable No. 1, in which the polymer has not undergone expansion, was taken as comparative non-expanded polymer coating. Table 3 also gives, for comparative purposes, the characteristics of a cable lacking the expanded filling and coated with only the outer sheath (cable No. 0).

TABLE 3

| Characteristics of the coating | | | |
|---|---|---|---|
| Cable No. | Degree of expansion of the filling (%) | Thickness of the filling (mm) | Sheath thickness (mm) |
| 0 | — | 0 | 3 |
| 1 | 0 | 1 | 3 |
| 2 | 31 | 4.3 | 3 |
| 3 | 61 | 1 | 3 |
| 4 | 48 | 2.5 | 3 |
| 5 | 5 | 3 | 3 |
| 6 | 35 | 2 | 2 |
| 7 | 52 | 2 | 2 |
| 8 | 29 | 3 | 2.2 |
| 9 | 23 | 2.5 | 2 |
| 10 | 78 | 4 | 2 |
| 11 | 82 | 4 | 2 |

In a similar manner to that described above, using an expanded polymer coating with a flexural modulus of about 600 MPa consisting of a polypropylene modified with about 30% of an EPR rubber, another 6 cable samples were prepared, as reported in Table 4 (Examples 12–17); Table 4 also gives two comparative examples of cables with expanded coating but lacking the outer sheath (Examples 16a and 17a).

TABLE 4

| Characteristics of the coating | | | |
|---|---|---|---|
| Cable No. | Degree of expansion of the filling (%) | Thickness of the filling (mm) | Sheath thickness (mm) |
| 12 | 71 | 3 | 1.9 |
| 13 | 22 | 2 | 2 |
| 14 | 167 | 3 | 1.8 |
| 15 | 124 | 2 | 2 |
| 16 | 56 | 2 | 2 |
| 16a | 56 | 2 | — |
| 17 | 84 | 2 | 2 |
| 17a | 84 | 2 | — |

EXAMPLE 2

Impact Strength Tests

In order to evaluate the impact strength of the cables prepared according to Example 1, impact tests were carried out on the cable with subsequent evaluation of the damage. The effects of the impact were evaluated both by means of visual analysis of the cable and by means of measuring the variation in peel strength of the layer of semiconductive material at the point of impact. The impact test is based on the French standard HN 33-S-52, which provides for an energy of impact on the cable of about 72 joules (J), which is obtained by dropping a 27 kg weight from a height of 27 cm. For the present test, such energy of impact has been produced by a 8 kg weight dropped from a height of 97 cm. The impact-end of the weight is provided with a V-shaped rounded-edge (1 mm curvature radius) punching head. For the purposes of the present invention, the impact strength was evaluated on a single impact. For samples 6–12, the test was repeated a second time at a distance of about 100 mm from the first.

The peel strength was measured according to the French standard HN 33-S-52, according to which the force needed to be applied in order to separate the outer semiconductive layer from the insulating layer is measured. By measuring this force continuously, force peaks are measured at the points at which the impact occurred. For each test piece, at the point of impact, a "positive" force peak was measured, corresponding to an increase in the force (relative to the average value) required to separate the two layers, and a "negative" force peak (decrease relative to the average value). From the difference between the maximum (Fmax) and minimum (Fmin) of the force peaks measured, the maximum variation in the peel strength at the point of impact is obtained.

The variation in the peel strength is thus calculated by determining the percentage ratio between the abovementioned difference (Fmax−Fmin) and the average peel strength value measured for the cable (F< >), according to the following relationship:

$$\%\ \text{variation}=100\ (Fmax-Fmin)/F<>$$

The size of the variation of this force measured at the points of impact, relative to the average value measured along the cable, thus gives an indication of the degree of protection provided by the expanded coating. In general, variations of up to 20–25% are considered to be acceptable. Table 5 gives the values of the variation in the peel strength for samples 0–17a.

TABLE 5

| Cable | % variation in the peel strength 1st test | 2nd test |
|---|---|---|
| 0 | 62 | 78 |
| 1 | 40 | — |
| 2 | 18 | — |
| 3 | 27 | — |
| 4 | 13 | — |
| 5 | 21 | — |
| 6 | 17 | 23 |
| 7 | 9 | 12 |
| 8 | 4 | 5 |
| 9 | 19 | 15 |
| 10 | 9.8 | 12.5 |
| 11 | 4.3 | 2.5 |
| 12 | 7 | 14 |
| 13 | 16 | 17 |
| 14 | 14 | 12 |
| 15 | 10 | 10 |
| 16 | 16 | 18 |
| 16a | 30 | 55 |
| 17 | 15.5 | 13 |
| 17a | 116 | 103 |

As is seen in Table 3, for sample 1 (for which no expansion was obtained), the percentage variation in peel strength is extremely high; this indicates that a non-expanded polymer has a decidedly lower capacity to absorb impacts than a layer of identical thickness of the same polymer which is expanded (see sample 3, with 61% expanded coating). Sample 3 shows a variation in the peel strength which is slightly above the 25% limit value; the limited impact strength provided by the sample may be attributed mainly to the thickness, of only 1 mm, of the expanded coating, relative to the 2–3 mm thicknesses of the other samples.

Sample 5, with an expanded coating thickness of 3 mm, has a high value of peel strength on account of the low degree of expansion of the polymer (5%), thus demonstrating the limited impact strength provided by a coating with a low degree of expansion. Sample 4, although having a thickness of expanded material which is less than that of sample 5 (2.5 mm as opposed to 3 mm), nevertheless has a higher impact strength, with a variation in the peel strength of 13% compared with 21% for sample 5, thereby demonstrating the fact that a higher degree of expansion affords a higher impact strength.

By comparing sample 13 with sample 15, it is seen how an increase in the degree of expansion of the polymer (from 22 to 124%), for the same thickness of the layer of expanded material and of the outer sheath, entails an increase in the impact strength of the coating (going from 16–17% to 10% of variation in the peel strength). This trend is confirmed by comparing sample 16 with sample 17. However, by comparing samples 16a and 17a (without outer sheath) with the respective samples 16 and 17, it may be seen how the contribution provided by the outer sheath towards the impact protection increases as the degree of expansion increases.

EXAMPLE 3

Impact Strength Comparison Test with Armored Cable

Cable no. 10 has been tested versus a conventional armored cable, in order to verify the impact strength efficiency of the expanded coating layer.

The armored cable has the same core as cable no. 10 (i.e. a multi-wire conductor about 14 mm in thickness coated with a layer of 0.5 mm of semiconductive material, a layer of 3 mm of an insulating mixture based on EPR and a further layer of 0.5 mm of "easy stripping" semiconductive material based on EVA supplemented with carbon black, for a total core thickness of about 22 mm). Said core is encircled, from the inside towards the outside of the cable by:

a) a layer of rubber-based filling material of about 0.6 mm thickness;
b) a sheath of PVC of about 0.6 mm thickness;
c) 2 armoring steel tapes of about 0.5 mm thickness each;
d) an outer sheath of MDPE of about 2 mm thickness.

For the comparison test, a dynamic machine of the "falling weight" type (CEAST, mod. 6758) has been employed. Two sets of tests has been carried out, by dropping a 11 kg weight from a height of 50 cm (energy impact of about 54 joule) and 20 cm (energy impact of about 21 joule), respectively; the weight is provided at its impacting end with a semispheric head of about 10 mm radius.

The resulting deformation of the cables is shown in FIGS. 4 and 5 (51 cm and 20 height, respectively), wherein the cable according to the invention if indicated with a), while the conventional armored cable is indicated with b).

The deformation of the core has been measured, in order to evalute the damages of the cable structure. As a matter of fact, higher deformations of the semiconductive-insulating-semicondutive sheath are more likely to cause electric defects in the insulating properties of the cable. The results are reported in table 6

TABLE 6

| | % reduction of the thickness of the semiconductive layer after impact: In conventional armored cable | In Cable no. 10 |
|---|---|---|
| 50 cm height impact | 41% | 26.5% |
| 20 cm height impact | 4.4% | 2.9% |

As apparent from the results reported in table 6, the cable of the invention shows even better impact strength performances than a conventional armored cable.

What is claimed is:

1. A power transmission cable, comprising:

an inner structure including a conductor and at least one layer of compact insulating coating surrounding the conductor; and a coating layer surrounding the inner structure to provide impact resistance, the coating layer being made of an expanded polymer material having a degree of expansion of from about 20% to about 3000% and a flexural modulus of at least 200 MPa before expansion of the expanded polymer material.

2. The power transmission cable of claim 1, wherein the flexural modulus is between 400 MPa and 1800 MPa.

3. The power transmission cable of claim 1, wherein the flexural modulus is between 600 MPa and 1500 MPa.

4. The power transmission cable of claim 1, wherein the degree of expansion of the polymer material is from about 30% to about 500%.

5. The power transmission cable of claim 1, wherein the degree of expansion of the polymer material is from about 50% to about 200%.

6. The power transmission cable of claim 1, wherein the coating layer of expanded polymer material has a thickness of between 1 and 6 mm.

7. The power transmission cable of claim 1, wherein the coating layer of expanded polymer material has a thickness of between 2 and 4 mm.

8. The power transmission cable of claim 1, wherein the expanded polymer material is chosen from polyethylene (PE), low density PE (LDPE), medium density PE (MDPE), high density PE (HDPE) and linear low density PE (LLDPE); polypropylene (PP); ethylene-propylene rubber (EPR), ethylene-propylene copolymer (EPM), ethylene-propylene-diene terpolymer (EPDM); natural rubber; butyl rubber; ethylene/vinyl acetate (EVA) copolymer polysterene; ethylene/acrylate copolymer, ethylene/methyl acrylate (EMA) copolymer, ethylene/ethyl acrylate (EEA) copolymer, ethylene/butyl acrylate (EBA) copolymer; ethylene/*-olefin copolymer; acrylonitrile-butadiene-styrene (ABS) resins; halogenated polymer, polyvinyl chloride (PVC); polyurethane (PUR); polyamide; aromatic polyester, polyethylene terephthalate (PET), polybutylene terephthalate (PBT); and copolymers or mechanical mixtures thereof.

9. The power transmission cable of claim 1, wherein the expanded polymer material is a polyolefin polymer or copolymer based on at least one of PE, PP, or combination thereof.

10. The power transmission cable of claim 9, wherein the polyolefin polymer or copolymer based on the at least one of PE, PP, or combination thereof also contains a predetermined amount of vulcanized rubber in powder form.

11. The power transmission cable of claim 10, wherein the predetermined amount of vulcanized rubber in powder form is between 10% and 60% of the weight of the expanded polymer material.

12. The power transmission cable of claim 1, wherein the expanded polymer material is a polyolefin polymer or copolymer based on at least one of PE, PP, or combination thereof modified with ethylene-propylene rubber.

13. The power transmission cable of claim 1, wherein the expanded polymer material is polypropylene (PP) modified with ethylene-propylene rubber (EPR), the PP/EPR weight ratio being between 90/10 and 50/50.

14. The power transmission cable of claim 13, wherein the PP/EPR weight ratio is about 70/30.

15. The power transmission cable of claim 13, wherein the PP/EPR weight ratio is between 85/15 and 60/40.

16. The power transmission cable of claim 1, further comprising an outer polymer sheath.

17. The power transmission cable of claim 16, wherein the outer polymer sheath is in contact with the expanded polymer coating.

18. The power transmission cable of claim 16, wherein the outer polymer sheath has a thickness of greater than 0.5 mm.

19. The power transmission cable of claim 16, wherein the outer polymer sheath has a thickness of between 1 and 5 mm.

20. The power transmission cable of claim 1, wherein the inner structure includes an inner semiconductive coating.

21. The power transmission cable of claim 1, wherein the inner structure includes an outer semiconductive coating.

22. The power transmission cable of claim 1, wherein the inner structure includes a metal screen.

23. A method for imparting impact strength to an inner structure of a cable, comprising:

providing an inner structure including a conductor and at least one layer of compact insulating coating surrounding the conductor; and disposing around said inner structure a layer of expanded polymer material, wherein said polymer material has a degree of expansion of from about 20% to about 3000% and a flexural modulus of at least 200 Mpa, measured at room temperature according to ASTM standard D790-96A, before expansion of said polymer.

* * * * *